US008512015B2

(12) United States Patent
Dugast et al.

(10) Patent No.: US 8,512,015 B2
(45) Date of Patent: Aug. 20, 2013

(54) PISTON REFRIGERATION COMPRESSOR

(75) Inventors: Philippe Dugast, Saint Bernard (FR); Patrice Bonnefoi, Saint Didier au Mont d'Or (FR); Jean De Bernardi, Lyons (FR); Philippe Dewitte, Saint Cyr au Mont d'or (FR)

(73) Assignee: Danfoss Commercial Compressors, Trevoux (FR)

( * ) Notice: Subject to any disclaimer, the term of this patent is extended or adjusted under 35 U.S.C. 154(b) by 35 days.

(21) Appl. No.: 13/201,383

(22) PCT Filed: Feb. 24, 2010

(86) PCT No.: PCT/FR2010/050311

§ 371 (c)(1), (2), (4) Date: Aug. 12, 2011

(87) PCT Pub. No.: WO2010/097542

PCT Pub. Date: Sep. 2, 2010

(65) Prior Publication Data

US 2012/0027633 A1 Feb. 2, 2012

(30) Foreign Application Priority Data

Feb. 27, 2009 (FR) ..... 09 51241

(51) Int. Cl.
*F04B 39/10* (2006.01)
*F04B 53/10* (2006.01)

(52) U.S. Cl.
USPC ..... 417/531; 417/439

(58) Field of Classification Search
USPC ..... 417/62, 269, 273, 312, 415, 439, 417/471, 504, 521, 522, 531, 540, 533, 538, 417/539, 542, 559, 569, 571; 92/72
See application file for complete search history.

(56) References Cited

U.S. PATENT DOCUMENTS

| | | | | |
|---|---|---|---|---|
| 5,326,231 | A * | 7/1994 | Pandeya et al. | 417/271 |
| 5,775,885 | A | 7/1998 | Dreiman et al. | |
| 6,568,921 | B2 * | 5/2003 | Dittrich | 417/312 |
| 2002/0062657 | A1 * | 5/2002 | Dittrich | 62/296 |
| 2003/0108435 | A1 * | 6/2003 | Meyer et al. | 417/255 |
| 2004/0156731 | A1 * | 8/2004 | Bond et al. | 417/415 |
| 2005/0271530 | A1 * | 12/2005 | Beagle | 417/440 |

FOREIGN PATENT DOCUMENTS

| | | |
|---|---|---|
| DE | 100 03 882 A1 | 8/2001 |
| EP | 1 283 364 A1 | 2/2003 |
| EP | 1 612 419 A1 | 1/2006 |
| JP | A-2-161178 | 6/1990 |

OTHER PUBLICATIONS

International Search Report dated May 7, 2010 in International Application No. PCT/FR2010/050311 (with translation).

* cited by examiner

*Primary Examiner* — Devon Kramer
*Assistant Examiner* — Bryan Lettman
(74) *Attorney, Agent, or Firm* — Oliff & Berridge, PLC

(57) ABSTRACT

This refrigeration compressor includes a plurality of compression units, each compression unit having a cylinder head including a refrigerant suction chamber and a refrigerant discharge chamber, a refrigerant distribution device having a distribution pipe and bypass pipes putting the distribution and the suction chambers of the compression units in communication, and a refrigerant discharge device having a discharge pipe and bypass pipes putting the discharge pipe and the discharge chambers of the compression units in communication. The compressor also includes a pressure equilibration pipe arranged to put the suction chambers of at least two compression units and/or the discharge chambers of at least two compression units in communication.

9 Claims, 4 Drawing Sheets

PISTON REFRIGERATION COMPRESSOR

The present invention relates to a piston refrigeration compressor.

A piston refrigeration compressor comprises, in a known manner, a plurality of compression units, each compression unit having a cylinder head comprising a refrigerant suction chamber and a refrigerant discharge chamber, a cylinder block comprising a cylinder delimiting a compression chamber and in which a piston is slidingly mounted, and a valve plate inserted between the cylinder head and the cylinder block.

The valve plate of each compression unit comprises a suction passage emerging in the corresponding suction chamber and the corresponding compression chamber, respectively, and a suction valve arranged only to allow a flow of refrigerant from the suction chamber towards the compression chamber.

The valve plate of each compression unit also comprises a discharge passage respectively emerging in the corresponding discharge chamber and in the corresponding compression chamber, and a discharge valve arranged only to allow a flow of refrigerant from the compression chamber towards the discharge chamber.

A compression unit of such a compressor operates as follows.

When the piston of the cylinder block moves in the cylinder away from the cylinder head, the pressure in the cylinder decreases and the discharge valve is moved into its closing position. Once the pressure in the cylinder is substantially lower than the pressure in the suction chamber, the suction valve is moved into its opening position and the refrigerant contained in the suction chamber is suctioned into the compression chamber via the suction passage.

When the piston of the cylinder block moves in the cylinder towards the cylinder head, the suction valve is moved into its closing position and the refrigerant contained in the compression chamber is compressed such that its temperature and pressure increase. Once the pressure in the cylinder is substantially greater than the pressure in the discharge chamber, the discharge valve is moved into its open position and the refrigerant contained in the compression chamber is discharged into the discharge chamber via the discharge passage.

The piston refrigeration compressor as described above also comprises, on the one hand, a refrigerant distribution device including a distribution pipe and bypass pipes putting the distribution pipe and the suction chambers of the compression units in compression, and on the other hand a refrigerant discharge device including a discharge pipe and bypass pipes putting the discharge pipe and the discharge chambers of the compression units in communication.

However, since the pressure in each suction and discharge chamber varies from a minimum value to a maximum value during the alternating movement of the corresponding piston, this results in the appearance of pressure pulses in the distribution and discharge devices that spread into the other suction and discharge chambers. These pressure pulses cause overpressures or vacuums in the suction and discharge chambers of each compression unit, which harms the operation of the suction and discharge valves of each compression unit.

These drawbacks therefore have the consequence that, for each compression unit, the refrigerant suction phase occurs at a pressure in the cylinder that is slightly below the minimum reference pressure and the refrigerant discharge phase occurs at a pressure in the cylinder that is slightly below the maximum reference pressure.

These suction and discharge pressure deviations relative to the reference pressures decrease the compressor's output, which harms the performance thereof.

The present invention aims to resolve these drawbacks.

The technical problem at the base of the invention therefore consists of providing a piston refrigeration compressor that has a simple and economical structure, while making it possible to prevent the appearance of pressure pulses of a nature to decrease the performance of the compressor.

To that end, the invention relates to a piston refrigeration compressor comprising:

- a crank,
- a plurality of compression units extending transversely to the axis of the crank, each compression unit having a cylinder head comprising a refrigerant suction chamber and a refrigerant discharge chamber,
- a refrigerant distribution device having a distribution pipe and bypass pipes putting the distribution pipe and the suction chambers of the compression units in communication,
- a refrigerant discharge device having a discharge pipe and bypass pipes putting the discharge pipe and the discharge chambers of the compression units in communication, characterized in that the compressor also comprises a pressure equilibration means arranged to put the suction chambers of at least two compression units and/or the discharge chambers of at least two compression units in communication.

The presence of the pressure equilibration means that makes it possible to put the suction chambers of at least two compression units and/or the discharge chambers of at least two compression units in communication makes it possible to reduce, on the one hand, the pressure pulses in these suction and/or compression chambers, and on the other hand the load losses created in the distribution and discharge devices. This consequently results in an increase in the compressor's performance.

According to one embodiment of the invention, the refrigeration compressor comprises a case in which the crank is mounted, the plurality of compression units being distributed over the periphery of the case. In the case of a hermetic-type compressor, the case could advantageously be surrounded by a sealing outer jacket. In the case of a semi-hermetic compressor, the case could form a sealed enclosure.

Advantageously, each compression unit extends substantially perpendicular to the axis of the crank.

Advantageously, the pressure equilibration means includes at least one equilibration pipe arranged to put the suction chambers of at least two compression units in communication and/or at least one equilibration pipe arranged to put the discharge chambers of at least two compression units in communication.

Preferably, the pressure equilibration means has at least one equilibration pipe comprising a first end emerging in one of the suction chambers and a second end emerging in another suction chamber, and/or at least one equilibration pipe comprising a first end emerging in one of the discharge chambers and a second end emerging in another discharge chamber.

According to one alternative embodiment of the invention, the pressure equilibration means has a collection chamber and at least two equilibration pipes each comprising a first end emerging in one of the suction chambers and a second end emerging in the collection chamber.

According to another alternative embodiment of the invention, the pressure equilibration means has a collection chamber and at least two equilibration pipes each comprising a first end emerging in one of the discharge chambers and a second end emerging in the collection chamber.

According to a first alternative of the invention, at least one of the equilibration pipes or each equilibration pipe extends to the outside of the compressor.

According to a second alternative of the invention, at least one of the equilibration pipes or each equilibration pipe extends inside the compressor.

Preferably, at least one of the equilibration pipes or each equilibration pipe is arranged in the case of the compressor.

Advantageously, at least one of the equilibration pipes or each equilibration pipe is a flexible or rigid tubing.

Preferably, at least one of the equilibration pipes or each equilibration pipe has a substantially constant section.

Advantageously, at least one of the equilibration pipes or each equilibration pipe has a section smaller than or equal to that of the distribution or discharge pipe.

Preferably, each compression unit also has a valve plate and a cylinder block delimiting a compression chamber, and the suction and discharge chambers of the cylinder head of each compression unit are each intended to be put in communication with the respective compression chamber via the respective valve plate.

Preferably, the cylinder block of each compression unit has a cylinder in which a piston is slidingly mounted in a direction substantially perpendicular to the axis of the crank between an end suction position in which said piston is moved away from the corresponding cylinder head and an end discharge position in which said piston is located near the corresponding cylinder head.

Advantageously, the compression units put in communication via the pressure equilibration means operate substantially in phase opposition.

The invention will be well understood using the following description in reference to the appended diagrammatic drawing showing, as non-limiting examples, several embodiments of this piston refrigeration compressor.

In the following description, the same elements are designated using the same references in the various embodiments.

Figure 1:
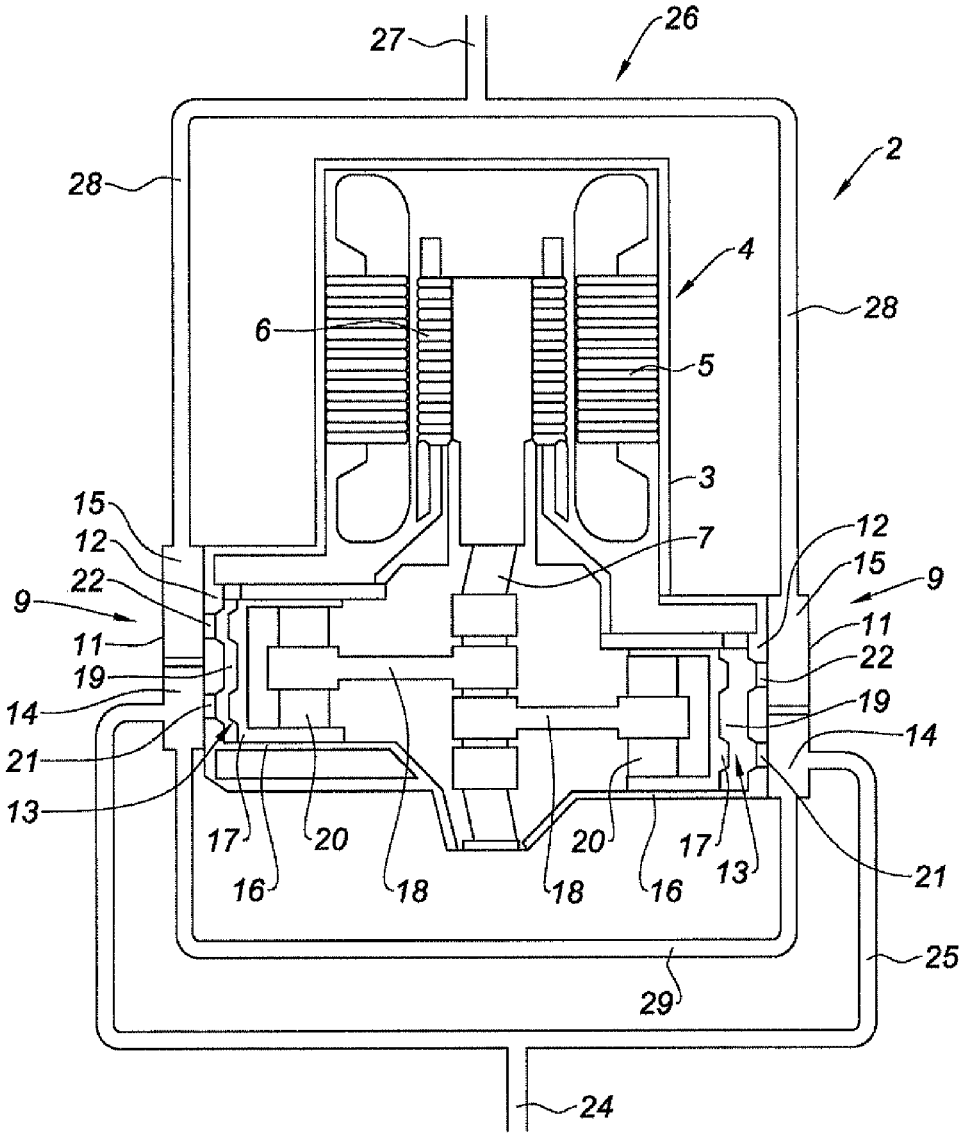
FIG. 1 is a diagrammatic cross-sectional view of a compressor according to a first embodiment of the invention.

FIG. 1 describes a piston refrigeration compressor 2 occupying a vertical position. However, the compressor according to the invention could occupy an inclined position, or a horizontal position, without its structure being significantly modified.

The compressor 2 comprises a sealed enclosure 3 in which an electric motor 4 is mounted comprising a stator 5 at the center of which a rotor 6 is arranged.

The compressor 2 also comprises a crank 7 whereof the upper end is secured to the rotor 6 and the lower end of which is engaged in a part 8 in the form of a sleeve secured to the compressor enclosure.

The compressor 2 also comprises four compression units 9 (only two compression units are shown in FIG. 1) regularly distributed over the circumference of the compressor enclosure and extending radially therefrom.

Each compression unit 9 has a cylinder head 11, a valve plate 12 and a cylinder block 13.

The cylinder head 11 of each compression unit 9 delimits a refrigerant suction chamber 14 and a refrigerant discharge chamber 15.

The cylinder block 13 of each compression unit 9 includes a cylinder 16 in which a piston 17 is slidingly mounted between an extreme suction position in which the piston 17 is distanced from the corresponding cylinder head 11 and an extreme discharge position in which the piston 17 is situated near the corresponding cylinder head 11, and a connecting rod 18 comprising a first end rotatably mounted around the crank 7 and a second end rotatably mounted around an axis 19 secured to the piston 17. The connecting rod 18 of each cylinder block 13 is arranged to convert the rotational movement of the crank 7 into a back-and-forth movement of the piston 17 of each cylinder block 13 inside the corresponding cylinder.

The two pistons 17 operate in phase opposition. Thus, when the piston 17 belonging to one of the compression units 9 is in its extreme suction position (see the piston located on the right in FIG. 1), the piston 17 belonging to the other compression unit 9 is in its extreme discharge position (see the piston located on the left in FIG. 1), and vice versa.

It should be noted that the valve plate 12, the cylinder 16 and the piston 17 of each compression unit 9 delimit a compression chamber 19.

The suction 14 and discharge 15 chambers of each cylinder head 11 are each intended to be put in communication with the corresponding compression chamber 19 via the corresponding valve plate 12.

The valve plate 12 of each compression unit 9 comprises a suction passage 21 respectively emerging in the corresponding suction chamber 14 and in the corresponding compression chamber 19, and a suction valve (not shown in FIG. 1) arranged to allow a flow of refrigerant through the suction passage 21 only from the suction chamber towards the compression chamber 19.

The valve plate 12 of each compression unit 9 also comprises a discharge passage 22 respectively emerging in the corresponding discharge chamber 15 and in the corresponding compression chamber 19, and a discharge valve (not shown in FIG. 1) arranged to allow a flow of refrigerant through the discharge passage 22 only from the compression chamber towards the discharge chamber.

The compressor 2 comprises a refrigerant distribution device 23 having a distribution pipe 24 and bypass pipes 25 pulling the distribution pipe 24 and the suction chambers 14 of two compression units 9 in communication.

The compressor 2 also comprises a refrigerant discharge device 26 having a discharge pipe 27 and bypass pipes 28 putting the discharge pipe 27 and the discharge chambers 15 of the compression units 9 in communication.

The compressor 2 also comprises a pressure equilibration means arranged to put the suction chambers 14 of the compression units 9 in direct communication.

The pressure equilibration means has an equilibration pipe 29 extending outside the compressor enclosure and comprising a first end emerging in one of the suction chambers 14 and a second end emerging in the other suction chamber 14.

The equilibration pipe 29 preferably has a substantially constant section substantially equal to that of the distribution and discharge pipes. Preferably, the length of the equilibration pipe is substantially larger than the diameter thereof, and in particular more than five times the diameter thereof.

Advantageously, the equilibration pipe is a rigid tubing.

Advantageously, the refrigerant flowing in the refrigerant distribution device is $CO_2$.

Figure 2:
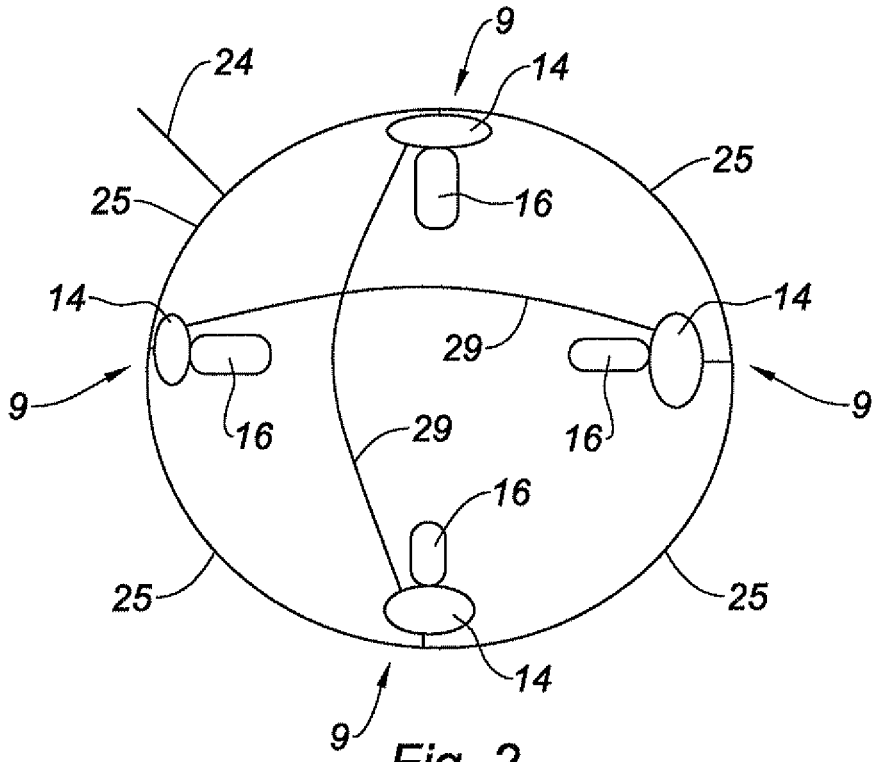
FIGS. 2 to 6 are diagrammatic views of compressors according to different alternative embodiments of the invention.

FIG. 2 shows a second embodiment of the invention.

According to this embodiment, the compressor 2 comprises four compression units 9 regularly distributed over the circumference of the compressor enclosure, and the pressure equilibration means has a first equilibration pipe 29 connecting the suction chambers 14 of two opposite compression units, and a second equilibration pipe 29 connecting the suction chambers 14 of the other two compression units.

Figure 3:
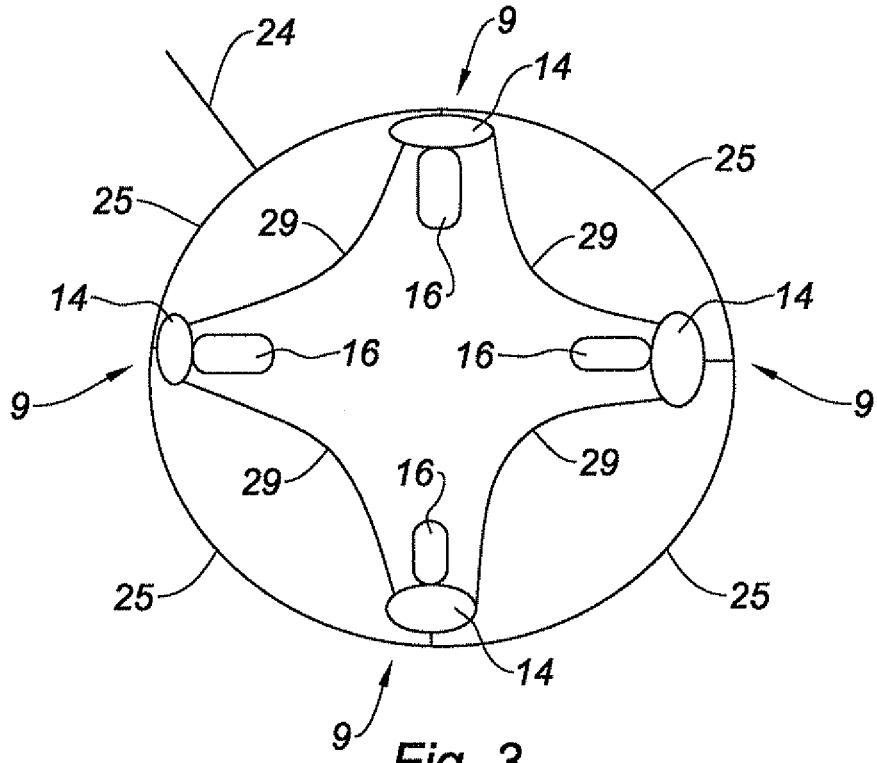

FIG. 3 shows a third embodiment of the invention.

According to this embodiment, the compressor comprises four compression units 9 regularly distributed over the circumference of the compressor enclosure, and the pressure equilibration means has four equilibration pipes 29 each connecting the suction chambers 14 of two adjacent compression units.

Figure 4:
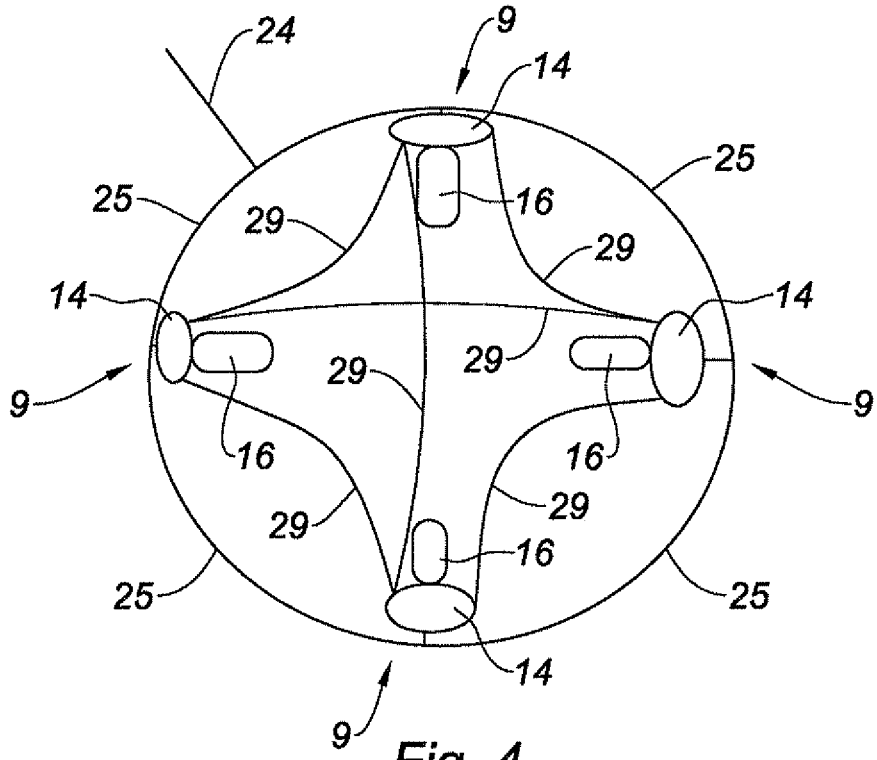

FIG. 4 shows a fourth embodiment of the invention.

According to this embodiment, the compressor differs from that shown in FIG. 3 in that the pressure equilibration means also has a fifth equilibration circuit 29 connecting the suction chambers 14 of two opposite compression units 9, and a sixth equilibration pipe 29 connecting the suction chambers 14 of the other two compression units 9.

Figure 5:
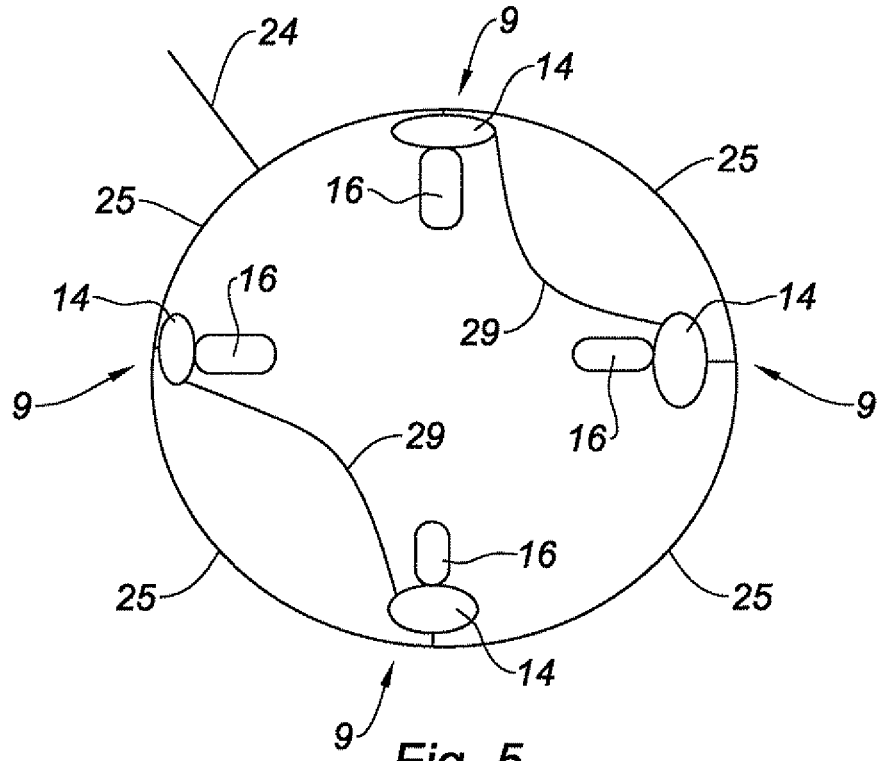

FIG. 5 shows a fifth embodiment of the invention.

According to this embodiment, the compressor comprises four compression units 9 regularly distributed over the circumference of the compressor enclosure, and the pressure equilibration means having a first equilibration pipe 29 connecting the suction chambers 14 of two adjacent compression units 9, and a second equilibration pipe 29 connecting the suction chambers 14 of the other two compression units.

Figure 6:
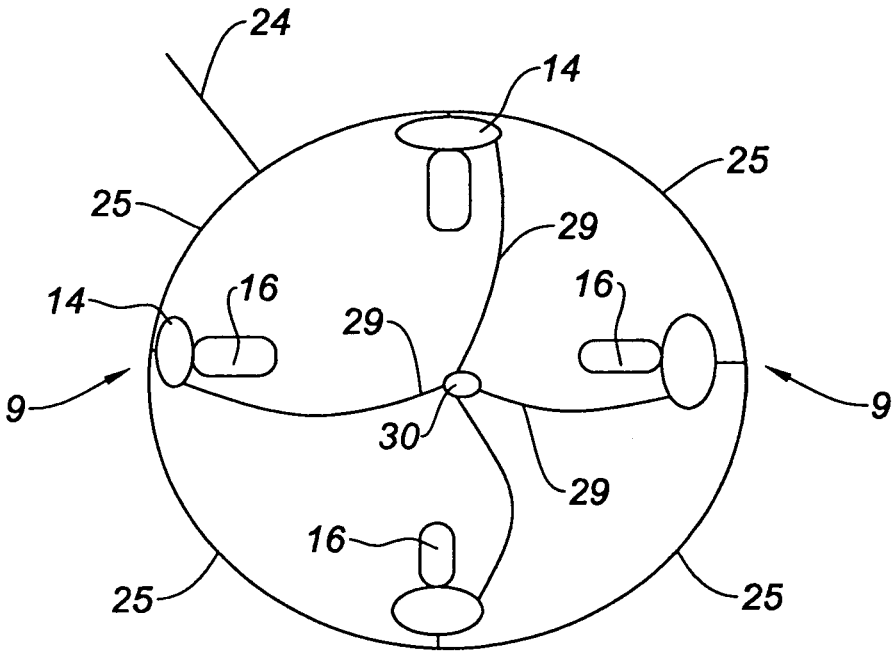

FIG. 6 shows a sixth embodiment of the invention.

According to this embodiment, the compressor comprises four compression units 9 regularly distributed over the circumference of the compressor enclosure, and the pressure equilibration means on the one hand has an external connection to the compressor enclosure and delimiting a collection chamber 30, and on the other hand four equilibration pipes 29 each comprising a first end emerging in one of the suction chambers 14 and a second end emerging in the collection chamber.

Of course, the invention is not limited solely to the embodiments of this piston refrigeration compressor described above as examples, but rather encompasses all alternative embodiments. It is particularly in this way that the pressure equilibration means could be arranged not to put the suction chambers of at least two compression units in communication, but to put the discharge chambers of at least two compression units in communication. The pressure equilibration means could also be arranged to put in communication on the one hand the suction chambers of at least two compression units, and on the other hand the discharge chambers of at least two compression units.

According to one alternative embodiment, the refrigeration compressor may be of the hermetic type. In that case, the enclosure 3 could be surrounded by an outer jacket.

The compression units could not be regularly distributed over the circumference of the compressor enclosure. For example, the cylinders of the compression units could be arranged in a V or W. The compression units could also not operate in phase opposition.

The invention claimed is:

1. A piston refrigeration compressor comprising:

a crank, a plurality of compression units extending transversely to a rotational axis of the crank, each compression unit having a cylinder head comprising a refrigerant suction chamber and a refrigerant discharge chamber, a refrigerant distribution device having a distribution pipe and bypass pipes putting the distribution pipe and the suction chambers in communication, a refrigerant discharge device having a discharge pipe and bypass pipes putting the discharge pipe and the discharge chambers in communication, wherein the compressor also comprises a pressure equilibration means arranged to put the suction chambers of at least two compression units and/or the discharge chambers of at least two compression units in communication, the pressure equilibration means having at least one equilibration pipe arranged to put the suction chambers of at least two compression units in communication, and/or at least one equilibration pipe arranged to put the discharge chambers of at least two compression units in communication, and in that at least one of the equilibration pipes extends outside the compressor.

2. The compressor according to claim 1, wherein the pressure equilibration means has at least one equilibration pipe comprising a first end emerging in one of the suction chambers and a second end emerging in another suction chamber, and/or at least one equilibration pipe comprising a first end emerging in one of the discharge chambers and a second end emerging in another discharge chamber.

3. The compressor according to claim 1, wherein the pressure equilibration means has a collection chamber and at least two equilibration pipes each comprising a first end emerging in one of the suction chambers and a second end emerging in the collection chamber.

4. The compressor according to claim 1, wherein the pressure equilibration means has a collection chamber and at least two equilibration pipes each comprising a first end emerging in one of the discharge chambers and a second end emerging in the collection chamber.

5. The compressor according to claim 1, wherein at least one of the equilibration pipes is a flexible or rigid tubing.

6. The compressor according to claim 1, wherein at least one of the equilibration pipes has a substantially constant section.

7. The compressor according to claim 1, wherein at least one of the equilibration pipes has a section smaller than or equal to that of the distribution or discharge pipe.

8. The compressor according to claim 1, wherein each compression unit also has a valve plate and a cylinder block delimiting a compression chamber, and in that the suction and discharge chambers of the cylinder head of each compression unit are each intended to be put in communication with the respective compression chamber via the respective valve plate.

9. The compressor according to claim 1, wherein the compression units put in communication via the pressure equilibration means operate substantially in phase opposition.

* * * * *